US007537144B1

(12) United States Patent
Marcinik et al.

(10) Patent No.: US 7,537,144 B1
(45) Date of Patent: May 26, 2009

(54) STITCHER SYSTEM WITH OUT OF WIRE DETECTOR

(75) Inventors: Robert F. Marcinik, Wallkill, NY (US); Anthony H. Vill, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 10 days.

(21) Appl. No.: 11/963,963

(22) Filed: Dec. 24, 2007

(51) Int. Cl.
*B25C 5/00* (2006.01)
*B27F 7/21* (2006.01)

(52) U.S. Cl. ..... 227/1; 227/2; 227/76; 227/82; 227/86; 270/37; 270/58.09; 242/566

(58) Field of Classification Search ..... 227/1, 227/2, 4, 81, 82, 83, 86, 88, 90, 110, 120; 270/52.18, 37, 58.09, 2, 58.08; 242/566, 242/563, 554.5, 563.2; 399/407, 410
See application file for complete search history.

(56) References Cited

U.S. PATENT DOCUMENTS 2,199,286 A * 4/1940 Fischer ..... 227/1
2,227,303 A * 12/1940 Flaws, Jr. ..... 200/61.15
3,417,492 A * 12/1968 Rutland et al. ..... 434/430
4,386,725 A * 6/1983 Chambers ..... 227/2
4,516,713 A * 5/1985 Meijer ..... 227/2
4,523,750 A * 6/1985 Hubler ..... 270/58.08
4,703,881 A * 11/1987 Riddell ..... 227/1
5,106,066 A * 4/1992 Shea et al. ..... 270/37
5,269,503 A * 12/1993 Hiroi et al. ..... 270/58.09
5,788,139 A * 8/1998 Sikora ..... 227/82
6,089,498 A * 7/2000 Sticht ..... 242/563
6,726,079 B2 * 4/2004 Munster ..... 227/83
6,918,580 B2 * 7/2005 Obregon et al. ..... 270/58.09

* cited by examiner

*Primary Examiner*—Scott A. Smith
(74) *Attorney, Agent, or Firm*—Christopher H. Kirkman; Steven J. Shapiro; Angelo N. Chaclas

(57) ABSTRACT

A stitcher system includes a stitcher mechanism for stitching collations of documents and adapted to form stitches from a conductive wire moved into the stitcher mechanism. A non-conductive spool is mounted for rotation on a spindle. A conductive wire is wound on the non-conductive spool. The conductive wire has a tail end adjacent to the non-conductive spool and a lead end remote from the spool. The spool rotates when the conductive wire is moved into the stitcher mechanism to provide conductive wire to be used by the stitcher mechanism to form stitches. A sensing circuit is provided with a circuit path that includes the conductive wire wrapped on the non-conductive spool and a conductive member mounted to engage the wire. The sensing circuit path becomes open when the conductive wire is not wrapped on the non-conductive spool to thereby detect an out of wire condition.

11 Claims, 3 Drawing Sheets

STITCHER SYSTEM WITH OUT OF WIRE DETECTOR

FIELD OF THE INVENTION

The present invention relates to a stitching (i.e., stapling) apparatus and, more particularly, to a stitcher system with an out of wire detector system.

BACKGROUND OF THE INVENTION

There are many applications known in which documents are fed along a paper path and then collated for further processing. Generally, the documents must be properly aligned when the collation is formed before further processing, such as stitching or insertion into an envelope, can be performed. In some applications, such as, for example, photocopying machines, the collation is formed and then stitched at a stacking area. Typically, stitching is done either at the leading edge or at the trailing edge of a collation. In either case the collation is stopped adjacent to the stitching mechanism and stitched. The formation and processing of stitching collations can be carried out at high processing speeds where large number of collations are stitched, for example, at speeds of 20,000 stitched collations per hour.

Stitcher systems are known in the art and are available in paper handling systems for a variety of applications in which stapling of documents is required. Stitcher systems employ a continuous wire moved from a spool into a stitcher mechanism, where a suitable length of wire is cut and then used to form a stitch for a collation of documents. The stitch may be bent into the form of an open rectangle or U-shape prior to further bending at the time of clinching (e.g., closing the stitch to secure the collation). The open rectangle consists of a two vertical legs and a substantially perpendicular leg connecting one end of each of the two vertical legs to form the open rectangle. Various wire bending shapes may be employed.

Depending on the orientation of the stitcher mechanism and its position in relation to the collation to be stitched, the open end of the formed rectangle or U-shape may have an orientation extending downwardly from the top side of the collation (a top stitcher) or upwardly from the bottom side of the collation (a bottom stitcher). The open end of the stitch is driven through the collation and, after clinching, the stitch may be in the form of a rectangle that is almost closed or fully closed on the bottom or the top of the collation, as the case may be. In such case the two vertical legs are clinched somewhere between their ends so that they face each other and form a substantially closed rectangle and secure the collation together by the formed stitch. The height of the stitch is the difference between the top side and the bent sections of the two legs.

SUMMARY OF THE INVENTION

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In accordance with the purpose of the invention, as embodied and broadly described herein, one aspect of the invention relates to a stitcher system including a spindle, a non-conductive spool mounted for rotation on the spindle, and a conductive wire wound on the non-conductive spool. In one embodiment, the conductive wire has a tail end adjacent to the non-conductive spool and a lead end remote from the non-conductive spool.

In another aspect, the stitcher system includes a stitcher mechanism receiving the lead end of the conductive wire and forming stitches from the wire for stitching collations of documents and a sensing circuit having a circuit path. In an embodiment, the circuit path includes the conductive wire wound on the non-conductive spool and a conductive member mounted to engage the conductive wire wound on the non-conductive spool. In a further embodiment, the circuit path becomes an open circuit when the conductive wire is not wrapped on the non-conductive spool to thereby detect an out of wire condition.

In a further aspect, the invention relates to a method of detecting an out of wire condition in a stitcher system, comprising providing a spindle and rotatably mounting on the spindle a non-conductive spool on which a conductive wire is wound. The conductive wire may have a tail end adjacent to the non-conductive spool and a lead end remote from the non-conductive spool. In another aspect, the method comprises receiving the lead end of the conductive wire in a stitcher mechanism and forming stitches from the wire for stitching collations of documents, and providing a sensing circuit having a circuit path. In an embodiment, the circuit path comprises the conductive wire wound on the non-conductive spool and a conductive member mounted to engage the conductive wire wound on the non-conductive spool, wherein the circuit path becomes an open circuit when the conductive wire is not wrapped on the non-conductive spool to thereby detect an out of wire condition.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of the specification, illustrate embodiments of the invention, and together with the general description given above and the detailed description of exemplary embodiments given below, serve to explain the principles of the invention. As shown throughout the drawings, like reference numerals designate like or corresponding parts.

DESCRIPTION OF EXEMPLARY EMBODIMENTS

Figure 1:
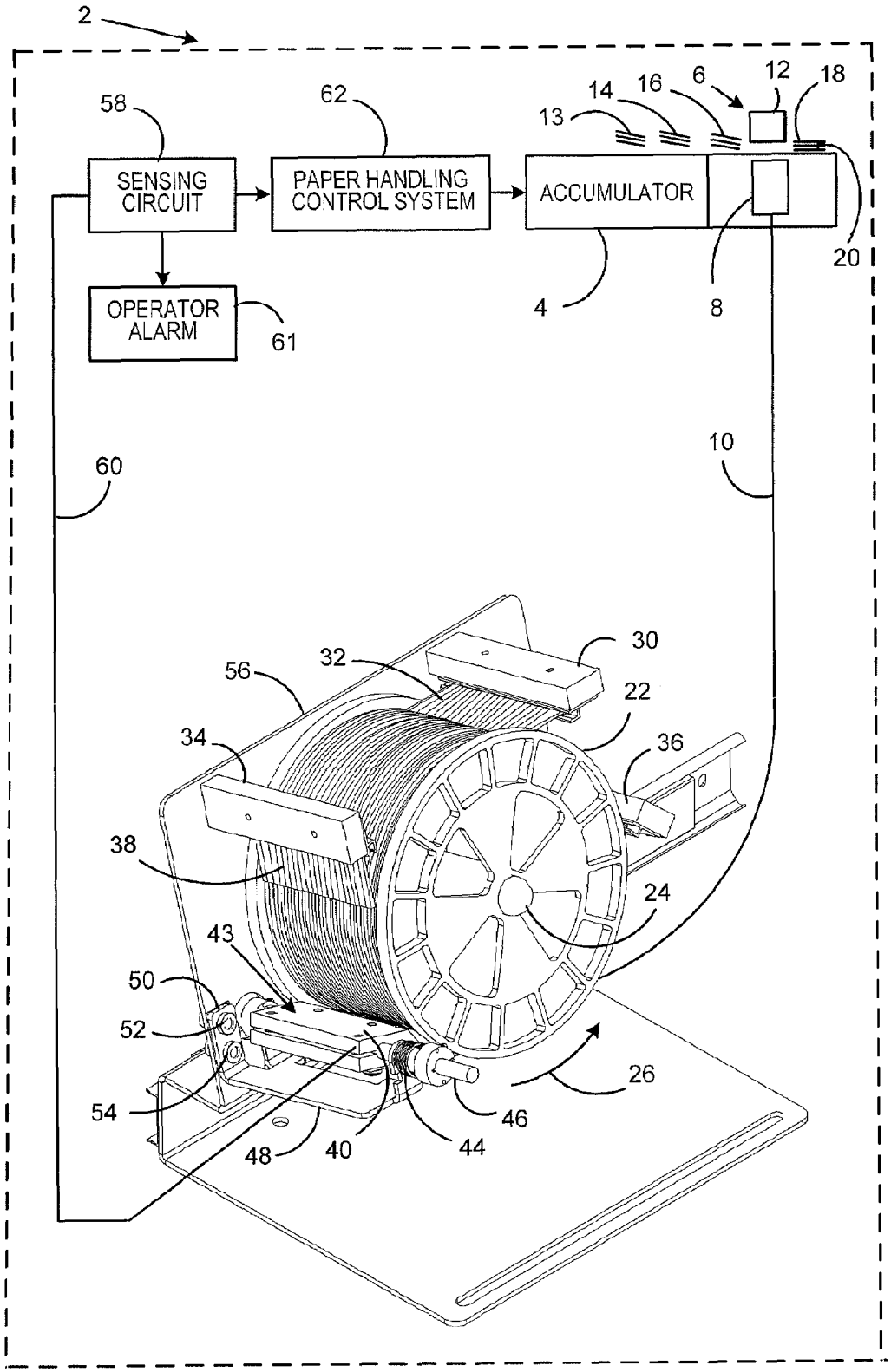
FIG. 1 is a block diagram of a paper handling system including a stitcher apparatus, partially in a perspective view, according to an embodiment of the invention.

As shown in FIG. 1, a paper handling system 2 includes an accumulator 4 and a stitcher mechanism 6. The stitcher mechanism 6 includes a stitcher head 8 into which a wire 10 is fed. The stitcher head 8 draws the wire 10 into the stitcher head, cuts the wire, bends the wire into a suitable shape, such as an open rectangle or U-shape, for example, and thereafter forces the wire through papers, such as an collation, to be driven against the clincher 12. The wire is fabricated from a conductive material, such as steel. Other conductive materials may also be used. The clincher 12 functions as an anvil for the forced shaped wire and causes the open ends of the shaped wire to be bent and to form a stitch for the collation. Various collations, such as collation 13, 14, and 16 are moved into an operative engagement with the stitcher mechanism 6, so that a stitched collation, such as collation 18 with a stitch 20, is formed. The stitch 20 is essentially a staple securing the collation together.

Wire 10 is drawn off a spool 22, which is mounted to rotate on a spindle 24. The spindle 24 is angled at approximately 15 degrees from the horizontal to provide a force that prevents the spool 22 from coming off the spindle 24 as the wire is drawn off the spindle 24. Other angles may also be used. The spool 22 is made out of a non-conductive material, such as plastic. Other non-conductive materials may also be used. The spindle 24 rotates in the direction of arrow 26 as the wire 10 is drawn off the spool 22.

Figure 3:
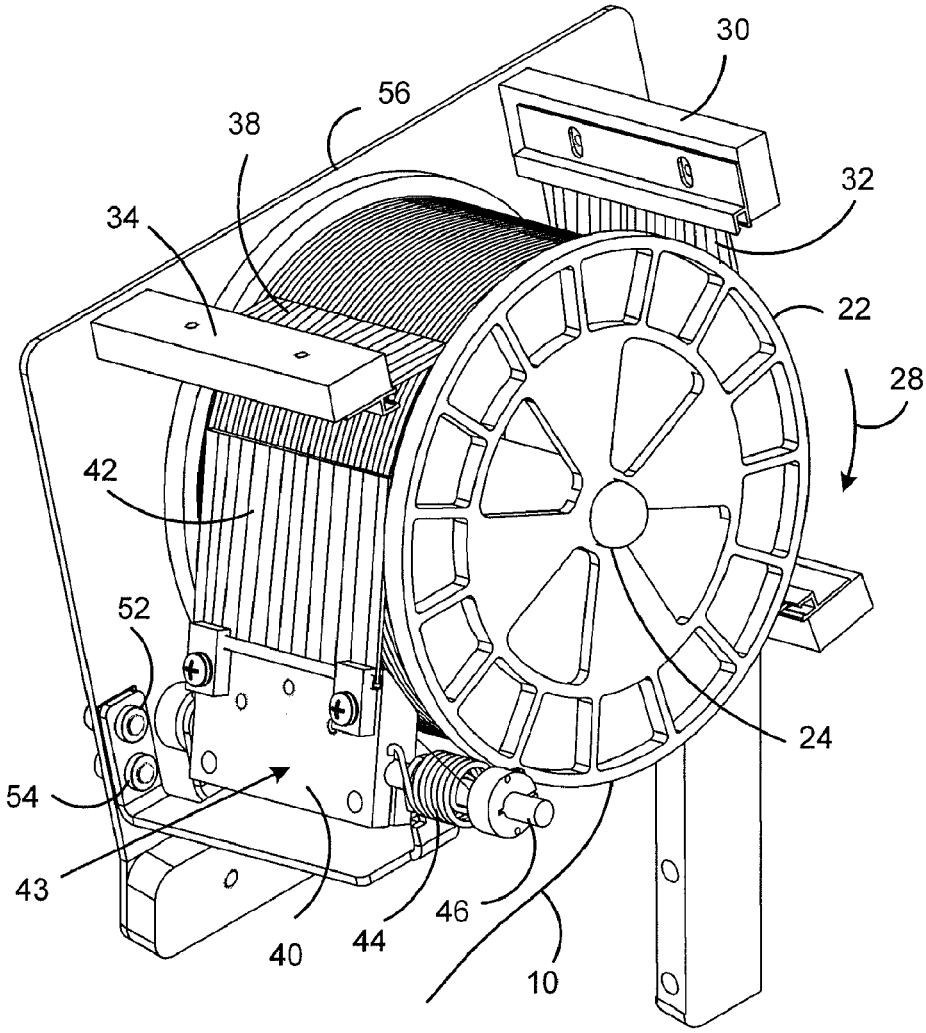
FIG. 3 is a partial perspective view of an embodiment of a stitcher apparatus of the type shown in FIG. 1 configured to be top-mounted in a paper handling system.

This is normally a desirable direction of rotation for this equipment when the spool is mounted at the bottom portion of the paper handling equipment. The wire is drawn off the spool and fed in an upward vertical direction. However, as shown in FIG. 3, the direction of rotation may be reversed when the spool is mounted at the top of the paper handling equipment. The wire in that case is drawn off the spool and fed in a downward vertical direction. As shown, the spool 22 rotates in the direction of arrow 28. This enables the stitch to be placed so that a top stitch or bottom stitch may be implemented as desired by the user to present the top of the stitch, as opposed to the legs of the stitch.

In the illustrated embodiments, several brushes comprising non-conductive bristles are mounted around the periphery of the spool 22 to contain the wire 10 as it is drawn off the spool 22. In one embodiment, the bristles comprise nylon, although other materials may also be used. Thus, a mounting bracket 30 supports a nylon bristle brush 32, which engages the wire 10 wrapped around the hub of the spindle-mounted spool 22.

In a like manner, a mounting bracket 34 supports a nylon bristle brush 38 and a mounting bracket 36 supports a nylon bristle brush not shown in FIG. 1. The brushes both contain the wire 10 on the spool 22 to prevent the wire from becoming loose and possibly tangling as it is drawn off the spool, and also contain the wire as the spool is being loaded. Other numbers and arrangements of brushes may also be used.

Figure 2:
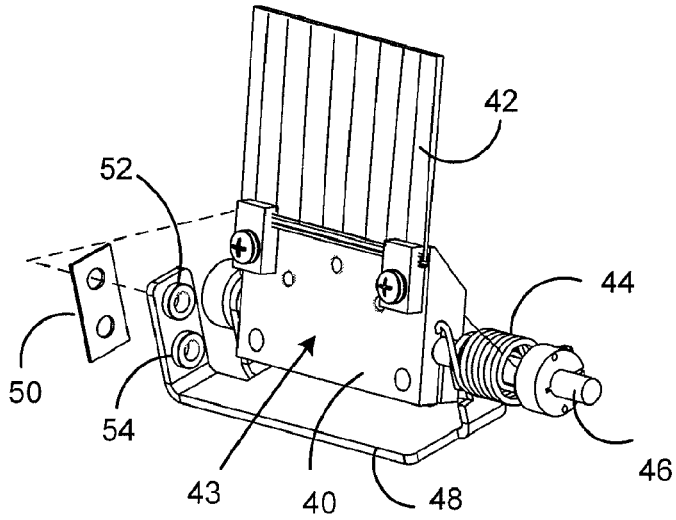
FIG. 2 is a perspective view of a component of the stitcher apparatus shown in FIG. 1.

In the embodiment shown in FIG. 1, a pivotable, spring-biased mounting bracket 40 supports a conductive bristle brush 42. In one embodiment, the bristles comprise brass. Other materials may also be used. The mounting bracket 40 and the conductive bristle brush 42 are part of a brush assembly, shown generally at 43 in FIGS. 1 and 2. The conductive bristle brush 42 is part of a circuit, which is employed to sense an out of wire condition of the conductive wire 10 on the non-conductive spool 22.

The conductive bristle brush 42 both contains the wire on the spool and also allows detection of when the out of wire condition occurs by interrupting a circuit. In the embodiment shown in FIG. 2, the pivotable mounting bracket 40 is biased by a torsion spring 44, such that the bracket 40 rotates on a shaft 46 to cause the conductive bristles of the brush 42 to be urged against the conductive wire 10 on the spool 22. Like the non-conductive bristle brushes, the conductive brush 42 also operates to contain the wire 10 on the spool 22 to prevent the wire from becoming loose and possibly tangling as it is drawn off the spool. When the wire 10 on the spool is depleted and an out of wire condition occurs, the conductive bristles of brush 42 are urged against the hub of the spool 22, which is non-conductive. This breaks a circuit path through the conductive wire 10 and the conductive bristle brush to signal that there is no more wire on the spool 22.

Because the conductive wire 10 and the conductive bristle brush 42 are part of a sensing circuit 58, the support bracket 48 that supports the pivotable mounting bracket 40 is insulated so as to be isolated from other conductive paths that may affect the operation of the sensing circuit 58. The support bracket 48 supports both the shaft 46 and the mounting bracket 40. An insulating spacer, such as a plate 50 and washers 52 and 54 also made out of insulating material, electrically isolate the conductive bristle brush 42 and the mounting bracket 40 from the rest of the mounting frame structure, such as the plate 56. The plate 50 and washers 52, 54 may comprise phenolic, nylon, or other insulating materials.

The sensing circuit 58 is connected by a wire 60 or other means to the conductive brush 42, for example, through the mounting bracket 40. When the wire 10 is depleted and an out of wire condition exists, the circuit path is broken and it becomes an open circuit. Thus, the circuit path through the wire 10, the conductive brush 42, and the bracket 40 is interrupted due to the out of wire condition. The out of wire condition functions similar to the opening of a switch 63 shown in FIG. 4.

Figure 4:
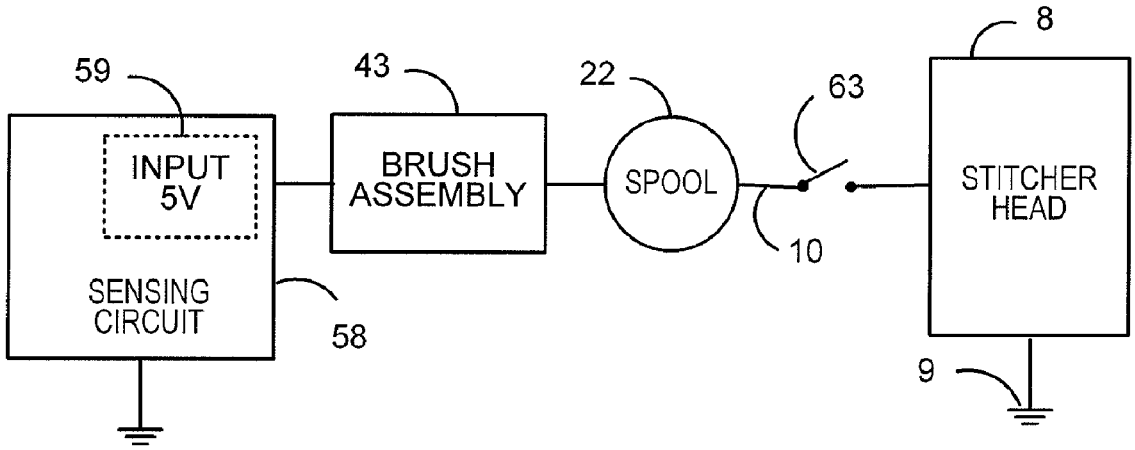
FIG. 4 is a diagram of an embodiment of the out of wire detector sensing circuit.

One of the boards, for example, board 59 in the sensing circuit 58, has a 5-Volt input. A wire is connected from the board to the brush assembly 43. The input is at 0 Volts as long as there is an unbroken circuit to the grounded stitcher head 8. The stitcher head ground is shown at 9. The switch 63 shown in FIG. 4 represents the wire/no wire condition. The switch 63 is open when there is no wire 10 connecting the brush assembly 43 and the stitcher head 8. When there is no wire, the input is at 5 Volts, since the voltage cannot go the ground. This changed voltage condition is employed to initiate the operator alarm 61, shown in FIG. 1.

In a further embodiment, the information from the sensing circuit 58 is provided to a paper handling control system 62, which is connected to control the accumulator 4 and the stitcher mechanism 6 to stop operation. This prevents the feeding of collations that would not be stitched due to the absence of wire 10. When the sensing circuit 58 detects the out of wire condition, it triggers an operator alarm 61 to notify an operator of the out of wire condition and of the need to load a new spool of wire in the stitcher apparatus. The operator alarm may be audible, visual, or a combination, providing both an audible and visual out of wire alarm.

In some embodiments, the stitcher mechanism 6 may be stopped by the paper handling control system 62 with wire still in the stitcher head 8. In that case, collations that are not stitched do not move out from stitcher mechanism 6. Moreover, the task of reloading the new wire spool and feeding the wire into the stitching mechanism is facilitated since residual wire 10 is left in the stitcher head 8 from the out of wire spool. The residual wire 10 can be pulled out of the stitcher head 8 using the tail end of the wire from the out of wire spool. New wire from a new spool can be fed easily into the stitcher head 8.

It will be apparent to those skilled in the art that various modifications and variations can be made to the structure and methodology described herein. For example, it should be recognized that the conductive bristle brush 42 may be any conductive member and need not a brush, provided such conductive member is in engagement with the conductive wire and is connected to be part of an out of wire sensing circuit. Moreover, the conductive member may be positioned to engage the wire after it is pulled off the spool and before it is fed into the stitcher mechanism head, whereby an out of wire condition of the spool would also be sensed.

Thus, it should be understood that the invention is not limited to the examples discussed in the specification. Rather, the present invention is intended to cover modifications and variations.

What is claimed is:

1. A stitcher system, comprising:

a spindle;

a non-conductive spool mounted for rotation on the spindle;

a conductive wire wound on the non-conductive spool, the conductive wire having a tail end adjacent to the non-conductive spool and a lead end remote from the non-conductive spool;

a stitcher mechanism receiving the lead end of the conductive wire and forming stitches from the wire for stitching collations of documents; and a sensing circuit having a circuit path comprising:

the conductive wire wound on the non-conductive spool; and a conductive member mounted to engage the conductive wire wound on the non-conductive spool, wherein the circuit path becomes an open circuit when the conductive wire is not wrapped on the non-conductive spool to thereby detect an out of wire condition.

2. The stitcher system of claim 1, further comprising a paper handling control system connected to the sensing circuit and to the stitcher mechanism, the paper handling control system stopping the operation of the stitcher mechanism when the sensing circuit path detects an out of wire condition.

3. The stitcher system of claim 2, wherein the paper handling control system stops the operation of the stitcher mechanism when the sensing circuit path detects an out of wire condition before the tail end of the conductive wire is moved into the stitcher mechanism.

4. The stitcher system of claim 1, wherein the conductive member is a conductive bristle brush.

5. The stitcher system of claim 4, wherein the conductive bristle brush is pivotably mounted and biased so that the conductive bristles continuously engage the conductive wire wound on the non-conductive spool as the conductive wire is moved into the stitcher mechanism and the conductive wire on the non-conductive spool is depleted.

6. The stitcher system of claim 5, further comprising:

a frame supporting the spindle and the conductive bristle brush; and insulating members, the insulating members positioned to electrically isolate the conductive bristle brush from the frame.

7. The stitcher system of claim 5, further comprising an accumulator connected to feed collations of documents to the stitcher mechanism.

8. The stitcher system of claim 7, wherein the paper handling control system is connected to the accumulator, the paper handling control system stopping the operation of the accumulator when the sensing circuit path detects an out of wire condition so that collations of documents are not fed to the stitcher mechanism when the stitcher mechanism is stopped.

9. The stitcher system of claim 1, further comprising an operator alarm, the operator alarm connected to the sensing circuit and triggered to provide an operator warning when the sensing circuit path detects an out of wire condition.

10. A method of detecting an out of wire condition in a stitcher system, the method comprising:

providing a spindle;

rotatably mounting on the spindle a non-conductive spool on which a conductive wire is wound, the conductive wire having a tail end adjacent to the non-conductive spool and a lead end remote from the non-conductive spool;

receiving the lead end of the conductive wire in a stitcher mechanism and forming stitches from the wire for stitching collations of documents; and providing a sensing circuit having a circuit path comprising:

the conductive wire wound on the non-conductive spool; and a conductive member mounted to engage the conductive wire wound on the non-conductive spool, wherein the circuit path becomes an open circuit when the conductive wire is not wrapped on the non-conductive spool to thereby detect an out of wire condition.

11. The method of claim 10, further comprising:

connecting a paper handling control system to the sensing circuit and to the stitcher mechanism; and stopping the operation of the stitcher mechanism using the paper handling control system when the sensing circuit path detects an out of wire condition.

* * * * *